US005412275A

United States Patent [19]

Dorsemagen et al.

[11] Patent Number: 5,412,275

[45] Date of Patent: May 2, 1995

[54] CAPPED ELECTRIC LAMP WITH CONNECTION CONDUCTOR BUTT WELDED TO A LAMP VESSEL CURRENT CONDUCTOR

[75] Inventors: Bernardus H. M. A. Dorsemagen, Geldrop, Netherlands; Manfred Westemeyer, Aldenhoven, Germany

[73] Assignee: U.S. Philips Corporation, New York, N.Y.

[21] Appl. No.: 55,434

[22] Filed: Apr. 29, 1993

[30] Foreign Application Priority Data

Jul. 13, 1992 [EP] European Pat. Off. ..... 92202134

[51] Int. Cl.[6] ..... H01J 5/48

[52] U.S. Cl. ..... 313/318.01; 313/315

[58] Field of Search ..... 313/315–318

[56] References Cited

U.S. PATENT DOCUMENTS 4,687,965 8/1987 Sanders et al. ..... 313/318
4,714,858 12/1987 Sanders ..... 313/318
4,868,457 9/1989 Strok ..... 313/318
5,051,658 9/1991 Van Pijkeren ..... 315/82
5,221,874 6/1993 Dayton ..... 313/318
5,313,134 5/1994 Borgis et al. ..... 313/318

*Primary Examiner*—Stephen Brinich
*Attorney, Agent, or Firm*—Brian J. Wieghaus

[57] ABSTRACT

The capped electric lamp has a quartz glass lamp vessel (1) with a first neck-shaped portion (2) which is kept fixed by the cap (20). First (4) and second (5) current supply conductors (4, 5) emanate from the neck-shaped portions (2 resp. 3) and are connected to contact members (24 resp. 25) of the cap, the second supply conductor (5) via a connecting conductor (7). The joint of the connection conductor (7) to a molybdenum end portion (5a) of the second supply conductor (5) is a butt weld (9). The joint is solid and reliable. An insulator tube (8) may be present around the connection conductor (7) and fixation means (10, 11 ) may be present to immobilize the tube.

14 Claims, 1 Drawing Sheet

CAPPED ELECTRIC LAMP WITH CONNECTION CONDUCTOR BUTT WELDED TO A LAMP VESSEL CURRENT CONDUCTOR

BACKGROUND OF THE INVENTION

The invention relates to a capped electric lamp comprising:

a quartz-glass lamp vessel with first and second neck-shaped portions in mutually opposed arrangement and comprising seals through which a first and a second current supply conductors, respectively, extend to an electric element arranged in the lamp vessel;

a connection conductor which has a welded connection to the second current supply conductor outside the lamp vessel;

a lamp cap of insulating material inside of which the lamp vessel is fixed to the first neck-shaped portion and which comprises contact members to which the first current supply conductor and the connection conductor, respectively, are connected.

Such a lamp, in which the electric element is a pair of electrodes, is known from U.S. Pat. No. 5,051,658. The lamp is suitable for use as a light source in optical systems, for example, as a vehicle head lamp.

The connection conductor in the known lamp is laid transversely over the second current supply conductor and is connected thereto in this crossed position by means of a resistance weld.

It was found that the weld is not reliable. The weld is not of a reproducible quality and may have, for example, only a small size and be brittle, so that the connection is broken, for example, in the case of a fluctuating mechanical load, for example, under the influence of shocks or vibrations. The lamp will then fall prematurely.

SUMMARY OF THE INVENTION

It is an object of the invention to provide an electric lamp of the kind mentioned in the opening paragraph in which the said risk of premature failure is counteracted and the connection conductor has a satisfactory connection to the second current supply conductor.

According to the invention, this object is achieved in that the weld of the connection conductor is a butt weld to a molybdenum end portion of the second current supply conductor.

The butt weld in the lamp according to the invention was found to be reliable and strong, also in the case of mechanized manufacture.

The electric element may be a pair of electrodes in an ionisable gas, but may alternatively be an incandescent body, for example, in an inert gas comprising a halogen.

It may be desirable to provide the connection conductor with an electrically insulating screen laterally of the lamp vessel, for example, to prevent detrimental effects of corona discharges which may occur when the lamp is ignited at a high voltage and a high frequency. Such a screen may alternatively be desirable for counteracting the disappearance of small ions, such as sodium, from the lamp vessel owing to photoemission.

It is easy for this purpose to provide a tube of insulating material around the connection conductor. The tube, however, may rattle or shift around said conductor. In a favourable embodiment, the lamp according to the invention comprises means for fixation of the tube.

It is favourable when the connection conductor has a curvature in the tube, which curvature lies in the tube clamping against said tube. Both axial and transversal movements of the tube around the conductor are counteracted thereby.

An alternative possibility is that the conductor, instead of or in addition to the former solution, comprises a stop for the tube between the tube and the welded joint, for example, a clamped or welded sleeve provided around the conductor. Very convenient, however, is a kink in the conductor. This may hamper an axial displacement and, depending on its position, also a transversal movement.

An outer envelope may be present around the lamp vessel. This envelope may be coupled to the first neck-shaped portion, for example, by means of a narrowed portion in this envelope.

The contact members at the lamp cap may be formed, for example, as pins, strips, bushes, etc., or a combination thereof, so as to cooperate with a connector which is connected to a supply source. It is also possible, however for an insulated cable to be fastened to each of the contact members with electrical conduction, which cables issue from a screen cover fastened to the lamp cap. Detachable electric connections can thus be moved to the supply source in this manner.

The lamp cap may consist of, for example, a synthetic resin, for example, a thermoplastic synthetic resin such as polyether imide, polyether sulphon, polyphenylene sulphide, polyether etherketone, polypropylene oxide, polyamide imide, polyimide, polybutylene terephthalate, which may be charged with powdery or fibrous substances such as, for example, glass, or chalk. The lamp cap may be integral with or form part of a reflector for the light generated by the lamp.

BRIEF DESCRIPTION OF THE DRAWINGS

Embodiments of the capped electric lamp according to the invention are shown in the drawings, in which.

DETAILED DESCRIPTION OF THE PREFERRED EMBODIMENTS

Figure 1:
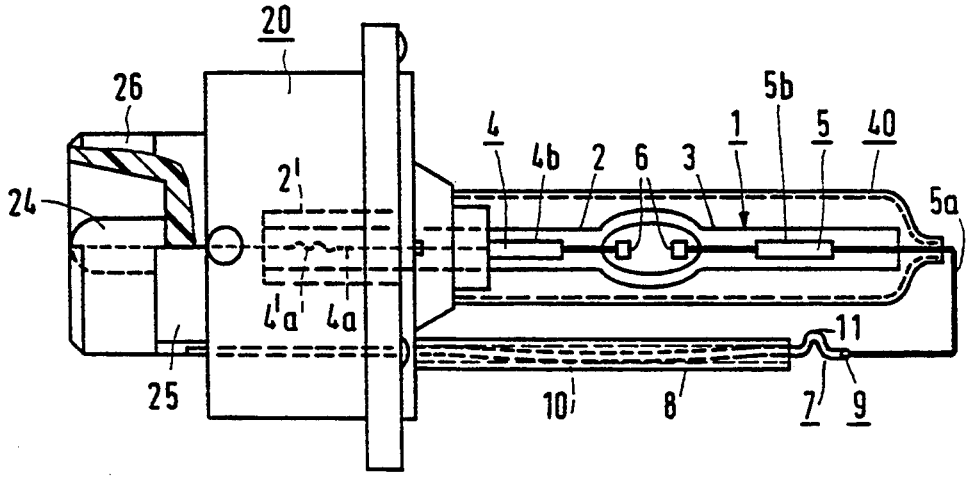
FIG. 1 shows a first embodiment in side elevation.

In FIG. 1, the capped electric lamp has a quartz glass lamp vessel 1 with a first 2 and a second neck-shaped portion 3 in mutually opposed arrangement and with seals through which respective current supply conductors 4, 5 extend to an electric element 6 arranged in the lamp vessel. This element in the Figure is a pair of electrodes in an ionisable gas.

A connection conductor 7, for example, made of nickel/manganese, for example nickel/manganese 98/2 by weight, has a weld 9 to the second current supply conductor 5 outside the lamp vessel 1. The lamp vessel 1 is fixed to the first neck-shaped portion 2 inside a lamp cap 20 of insulating material. The lamp cap has contact members 24, 25 to which the first current supply conductor 4 and the connection conductor 7, respectively, are connected. In the Figure, the lamp vessel has an outer envelope 40. The contact member 24 is a central pin, surrounded by an annular contact 25 at the outside of a collar 26. The lamp cap can cooperate with a bayonet connector.

The weld 9 of the connection conductor 7 is a butt weld to a molybdenum end portion 5*a* of the second current supply conductor 5.

The end portion 5*a* in the Figure is connected to a metal foil 5*b*, for example made of molybdenum, to which an electrode 6 is welded.

The connection conductor 7 is surrounded by a tube 8 of insulating material, for example of ceramic material such as, for example, steatite or aluminium oxide, and comprises means 10, 11 for fixing this tube 8 immovably.

In FIG. 1, the connection conductor 7 has a curvature 10 which lies with clamping action in the tube 8. The connection conductor 7 in addition has a stop 11 for the tube between the tube 8 and the weld 9. The stop 11 is a kink in the connection conductor 7.

The first current supply conductor 4 has an end portion 4*a* with an undulated portion 4*a'* therein which is connected to a metal foil 4*b* to which an electrode 6 is welded. The portion 4*a'* lies in an open tubular end portion 2' of the first neck-shaped portion 2 and offers said conductor expansion and contraction possibilities independently of its surroundings.

Figure 2:
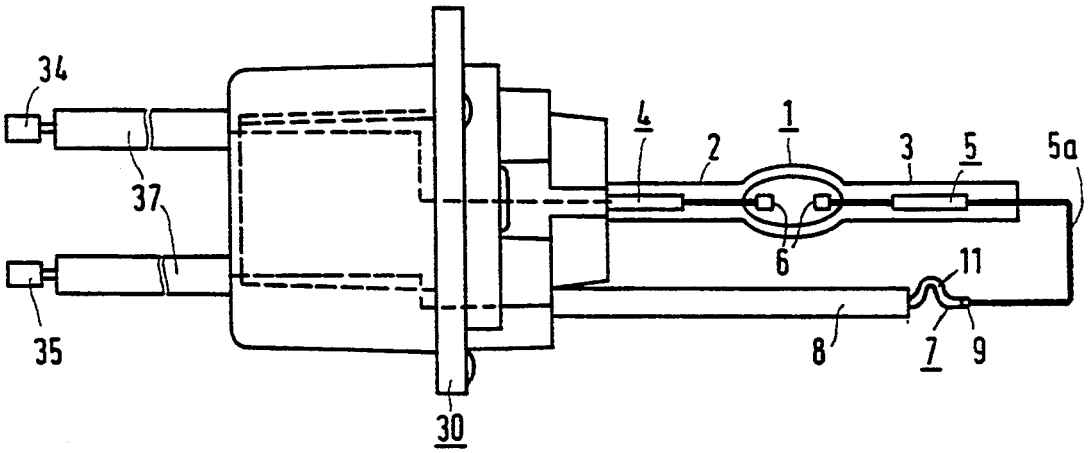
FIG. 2 shows a second embodiment in side elevation.

In FIG. 2, a similar lamp vessel has a lamp cap 30 with contact members 34, 35 at cables 37 issuing from the lamp cap to the exterior. A kink 11 in the connection conductor 7 is present for immovably fixing the tube 8 of insulating material.

We claim:

1. A capped electric lamp, comprising:

a) a lamp cap of insulating material, said lamp cap including a pair of electrical lamp cap contacts;

b) a quartz glass lamp vessel comprising an electric element which is energizeable for emitting light, said lamp vessel including first and second opposing elongate neck-shaped portions, said neck-shaped portions including respective seals, and first and second molybdenum current conductors each extending from said electric element through a respective seal in a gas-tight manner, said lamp cap holding said lamp vessel at said first seal, and said first current conductor being connected to one of said lamp cap contacts, the second current conductor issuing from said second seal and terminating at a free end; and c) a connection conductor connected to said other lamp cap contact, extending from said lamp cap along said lamp vessel, and having a free end butt welded to said free end of said second current conductor.

2. A capped electric lamp as claimed in claim 1, characterized in that the connection conductor is surrounded by a tube of insulating material and comprises fixing means for fixing this tube immovably.

3. A capped electric lamp as claimed in claim 2, characterized in that the fixing means comprises said connection conductor having a curved portion which lies within and clamps against said tube.

4. A capped electric lamp as claimed in claim 3, characterized in that said fixing means further comprises the connection conductor having a stop for the tube between said tube and the butt weld.

5. A capped electric lamp as claimed in claim 4, characterized in that the stop is a kink in the connection conductor.

6. A capped electric lamp as claimed in claim 2, characterized in that the connection conductor (7) has a stop (11) for the tube (8) between said tube and the weld (9).

7. A capped electric lamp as claimed in claim 6, characterized in that the stop (11) is a kink in the connection conductor (7).

8. A capped electric lamp, comprising:

a) a lamp cap of insulating material, said lamp cap including a pair of electrical lamp cap contacts;

b) a lamp vessel which is energizeable for emitting light, said lamp vessel including first and second opposing seals and first and second current conductors each extending through a respective seal in a gas-tight manner, said lamp cap holding said lamp vessel at said first seal and said first current conductor being connected to one of said lamp cap contacts, the second current conductor issuing from said second seal and terminating at a free end; and c) a connection conductor connected to said other lamp cap contact, extending from said lamp cap along said lamp vessel, and having a free end butt welded to said free end of said second current conductor.

9. A capped electric lamp according to claim 8, further comprising a tube of insulating material surrounding a portion of said connection conductor, and wherein said connection conductor comprises fixing means for fixing said tube to said connection conductor.

10. A capped electric lamp as claimed in claim 9, characterized in that the fixing means comprises said connection conductor having a curved portion which lies within and clamps against said tube.

11. A capped electric lamp as claimed in claim 10, characterized in that said fixing means further comprises the connection conductor having a stop for the tube between said tube and the butt weld.

12. A capped lamp as claimed in claim 11, characterized in that the stop is a kink in the connection conductor.

13. A capped electric lamp as claimed in claim 9, characterized in that said fixing means further comprises the connection conductor having a stop for the tube between said tube and the butt weld.

14. A capped lamp as claimed in claim 13, characterized in that the stop is a kink in the connection conductor.

* * * * *